US008607462B2

(12) United States Patent
Palmer

(10) Patent No.: US 8,607,462 B2
(45) Date of Patent: Dec. 17, 2013

(54) CHAINSAW AND ATTACHMENT THEREFOR

(76) Inventor: Kenneth J. Palmer, Dallas, TX (US)

( * ) Notice: Subject to any disclaimer, the term of this patent is extended or adjusted under 35 U.S.C. 154(b) by 309 days.

(21) Appl. No.: 12/653,708

(22) Filed: Dec. 17, 2009

(65) Prior Publication Data

US 2011/0146086 A1 Jun. 23, 2011

(51) Int. Cl.
*B27B 17/00* (2006.01)

(52) U.S. Cl.
USPC ..... 30/382

(58) Field of Classification Search
USPC ..... 30/371, 374, 381–387; D8/70
See application file for complete search history.

(56) References Cited

U.S. PATENT DOCUMENTS

| | | | | | |
|---|---|---|---|---|---|
| 2,642,901 | A | * | 6/1953 | Hayden | 30/371 |
| 2,777,482 | A | * | 1/1957 | Chamberlain et al. | 30/371 |
| 2,813,556 | A | * | 11/1957 | Woodworth | 30/371 |
| 2,821,213 | A | * | 1/1958 | York | 30/371 |
| 2,921,613 | A | * | 1/1960 | Silvey | 30/387 |
| 2,925,105 | A | * | 2/1960 | Hayden | 30/371 |
| 2,930,416 | A | * | 3/1960 | Granberg | 30/371 |
| 2,948,310 | A | * | 8/1960 | Herron | 30/371 |
| 3,051,203 | A | * | 8/1962 | Hayden | 30/371 |
| 3,092,156 | A | * | 6/1963 | Hayden | 30/371 |
| 3,292,671 | A | * | 12/1966 | Stromberg | 30/382 |
| 3,540,500 | A | * | 11/1970 | Greene | 30/382 |
| 3,931,676 | A | * | 1/1976 | Merle | 30/371 |
| 3,991,470 | A | * | 11/1976 | Cartmill | 30/382 |
| 4,142,292 | A | * | 3/1979 | Ulrich | 30/371 |
| 4,143,460 | A | * | 3/1979 | Shean | 30/382 |
| 4,290,202 | A | * | 9/1981 | Nadenoff | 30/382 |
| 4,317,285 | A | * | 3/1982 | Graham | 30/371 |
| 4,388,762 | A | * | 6/1983 | Debell et al. | 30/383 |
| 4,463,499 | A | * | 8/1984 | Fritz | 30/382 |
| 4,748,745 | A | * | 6/1988 | Woodbridge | 30/383 |
| 4,858,325 | A | * | 8/1989 | Miller | 30/383 |
| 4,951,398 | A | * | 8/1990 | Bennett et al. | 30/383 |
| 5,074,047 | A | * | 12/1991 | King | 30/382 |
| D365,505 | S | * | 12/1995 | Raya | D8/70 |
| 5,560,111 | A | * | 10/1996 | Dofredo | 30/371 |
| 5,669,145 | A | * | 9/1997 | Skripsky | 30/371 |
| 5,671,537 | A | * | 9/1997 | Dofredo | 29/740 |
| 6,038,775 | A | * | 3/2000 | Holladay | 30/387 |
| 6,161,453 | A | * | 12/2000 | Hensley | 30/381 |
| 6,311,598 | B1 | * | 11/2001 | Osborne | 30/383 |
| 2002/0053270 | A1 | * | 5/2002 | King | 30/383 |
| 2008/0164400 | A1 | * | 7/2008 | Beechinor | 30/381 |
| 2008/0196257 | A1 | * | 8/2008 | Eller | 30/381 |
| 2011/0167649 | A1 | * | 7/2011 | Reed et al. | 30/371 |

* cited by examiner

*Primary Examiner* — Jason Daniel Prone
(74) *Attorney, Agent, or Firm* — W. Thomas Timmons

(57) ABSTRACT

An attachment for a chainsaw has a lock strip aligned with and near the bottom edge of the chain bar. A plurality of substantially C-shaped stop members engage non-circular indentations formed in the lock strip with one leg and the opposite side of the chain bar with the other leg. The substantially C-shaped stop members are large enough to go around the chain without touching the chain and to block brush and small limbs from being dragged by the chain into the housing. A tightening screw is associated with each of the plurality of substantially C-shaped stop members for holding the C-shaped stop member in a tight relationship with both the lock strip and the chain bar.

15 Claims, 3 Drawing Sheets

CHAINSAW AND ATTACHMENT THEREFOR

CROSS-REFERENCE TO RELATED APPLICATIONS

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to chainsaws and, in one of its aspects to chainsaws and chainsaw attachments for sawing brush and small limbs without the cutting chain dragging the cut brush or small limbs into the chainsaw housing.

2. Description of Related Art

U.S. Pat. No. 4,317,285 to Graham shows the use of a chainsaw attachment for cutting brush. The attachment is near the tip and restricts the amount of cutting chain that is actually doing the work.

U.S. Pat. No. 4,748,745 to Woodbridge shows a brush attachment for keeping the chain clean, but it does not prevent matter from being dragged into the housing on the bottom, return, side of the chain.

U.S. Pat. No. 5,669,145 shows a chainsaw attachment for cutting brush and small limbs. The attachment is only on one side of the chain and involves drilling extra holes into the chain bar.

BRIEF SUMMARY OF THE INVENTION

An attachment for use with a chain saw having a housing containing a motor with a chain bar extending outwardly from the housing and a cutting chain driven by the motor so as to travel longitudinally around the top and bottom of the chain bar, includes a lock strip aligned with and near the bottom edge of the chain bar, wherein the lock strip forms a plurality of non-circular indentations, and a plurality of substantially C-shaped stop members for engaging the non-circular indentations formed in the lock strip with one leg and the opposite side of the bar chain with the other leg, wherein the leg of the substantially C-shaped stop member, which engages the non-circular indentation forms a shape which mates with the shape of the indentation, creating a snug fit. The substantially C-shaped stop members are large enough to go around the chain without touching the chain and to block brush and small limbs so as to be cut and from being dragged by the chain into the housing. A preferred form of the attachment also includes a plurality of tightening screws, one tightening screw associated with each of the plurality of substantially C-shaped stop members for holding the C-shaped stop member in a tight relationship with both the lock strip and the chain bar, wherein each substantially C-shaped stop member forms a threaded opening for receiving the tightening screw.

In one arrangement of an attachment according to the present invention, each of the plurality of non-circular indentations is substantially square and the shape of the mating part of the leg of the substantially C-shaped stop member is also square to create a snug fit of the end of the leg into the indentation. Further, the lock strip also forms a plurality of circular cutouts, one circular cutout in the bottom of each substantially square indentation, through which the tightening screw tightens the substantially C-shaped stop member and, therefore, the lock strip directly against the chain bar.

The non-circular indentation and mating leg of the substantially C-shaped stop members can be at any angle or even at different angles with respect to each other, but in one preferred arrangement, the substantially C-shaped stops are at a substantially right angle to the bottom edge of the chain bar.

In a preferred form of an attachment according to the present invention, the tightening screws and the substantially C-shaped stop members can be removed and the lock strip can be moved to different places along the bottom edge of chain bar, where the substantially C-shaped stop members and the tightening screws can be re-attached.

A chainsaw according to the present invention includes a housing, a motor within the housing, a chain bar extending outwardly from the housing, a cutting chain driven by the motor so as to travel longitudinally around the top and bottom of the chain bar, a lock strip aligned with and near the bottom edge of the chain bar, wherein the lock strip forms a plurality of non-circular indentations, and a plurality of substantially C-shaped stop members for engaging the non-circular indentations formed in the lock strip with one leg and the opposite side of the bar chain with the other leg. The leg of the substantially C-shaped stop member, which engages the non-circular indentation, forms a shape which mates with the shape of the indentation, creating a snug fit.

A chainsaw according to the present invention, further includes a plurality of tightening screws, one tightening screw associated with each of the plurality of substantially C-shaped stop members for holding the C-shaped stop member in a tight relationship with both the lock strip and the chain bar, wherein each substantially C-shaped stop member forms a threaded opening for receiving the tightening screw. In a preferred form, each of the plurality of non-circular indentations is substantially square and the shape of the mating part of the leg of the substantially C-shaped stop member is also square to create a snug fit of the end of the leg into the indentation. The lock strip also forms a plurality of circular cutouts, one circular cutout in the bottom of each substantially square indentation, through which the tightening screw tightens the substantially C-shaped stop member and, therefore, the lock strip directly against the chain bar.

Once again, the substantially C-shaped stops can be at a variety of angles with respect to the bottom of the chain bar, but typically are at a substantially right angle to the bottom edge of the chain bar.

In a chainsaw according to the present invention, the tightening screws and the substantially C-shaped stop members can be removed and the lock strip can be moved to different places along the bottom edge of chain bar, where the substantially C-shaped stop members and the tightening screws can be re-attached.

These and other objects, advantages and features of this invention will be apparent from the following description taken with reference to the accompanying drawing, wherein is shown a preferred embodiment of the invention.

DETAILED DESCRIPTION OF THE INVENTION

Figure 1:
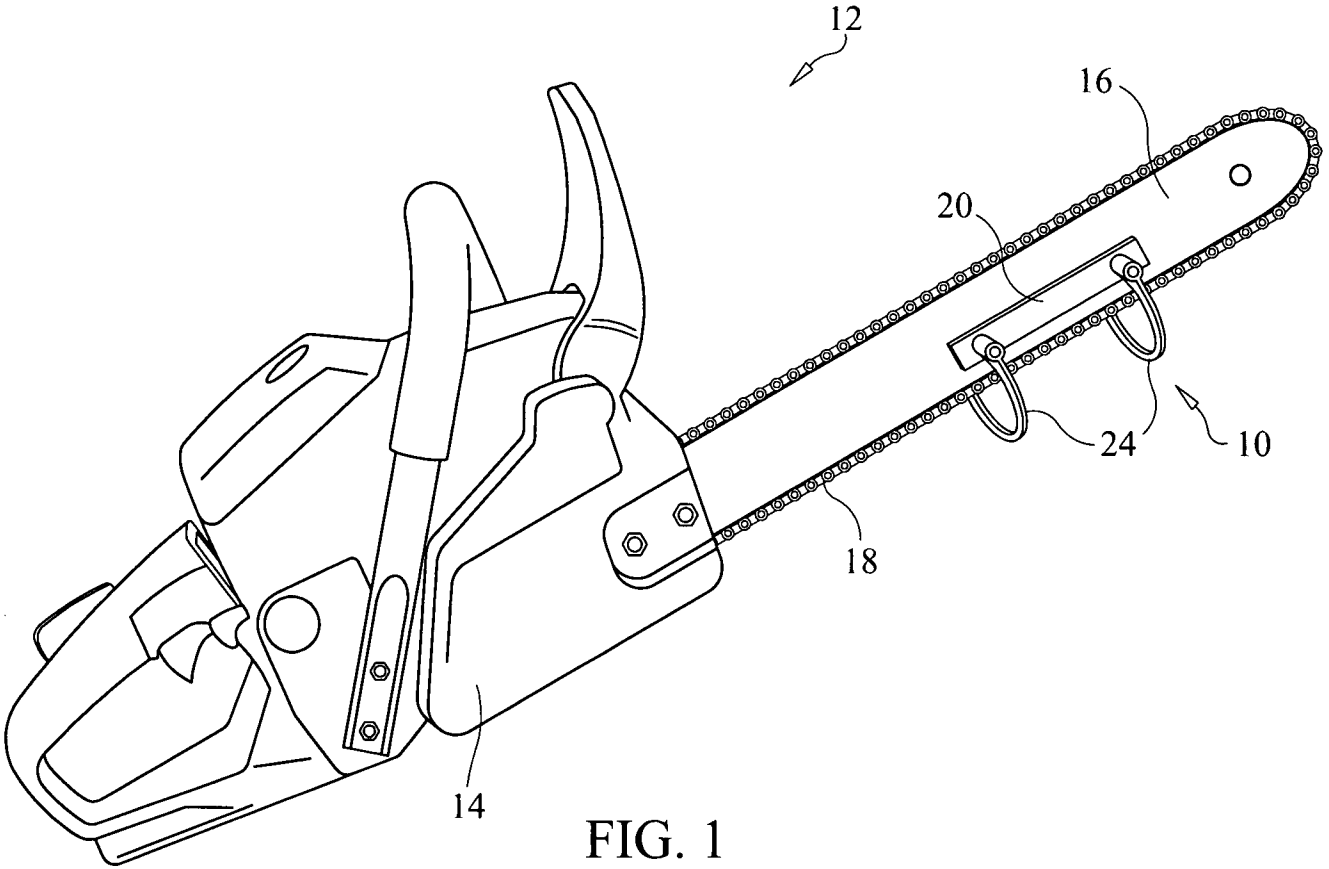
FIG. 1 is a perspective view of a chainsaw according to the present invention including an attachment according to the present invention.
Figure 2:
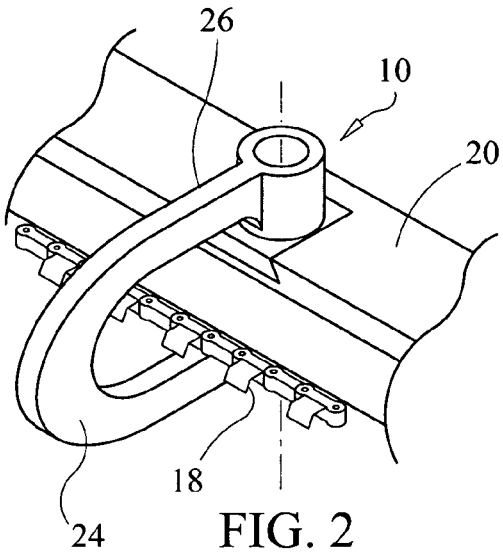
FIG. 2 is a perspective view of a section of the attachment and chainsaw of FIG. 1.
Figure 3:
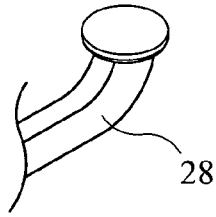
FIG. 3 is a detail of the underside of the attachment of FIG. 2.
Figure 4:
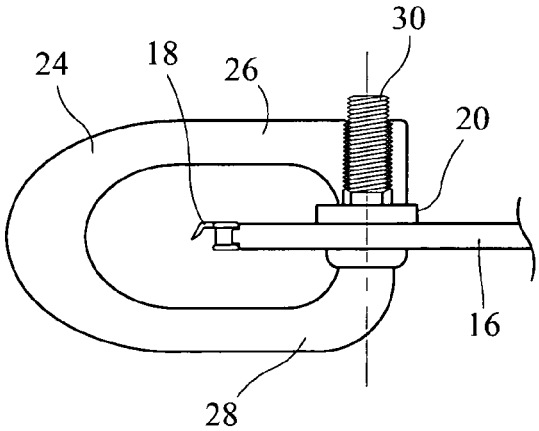
FIG. 4 is a right side elevation view of the attachment of FIG. 2, showing the chain and chain bar in section.
Figure 5:
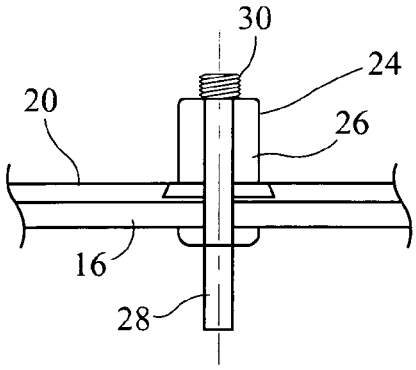
FIG. 5 is a front elevation view of the attachment of FIG. 2.
Figure 6:
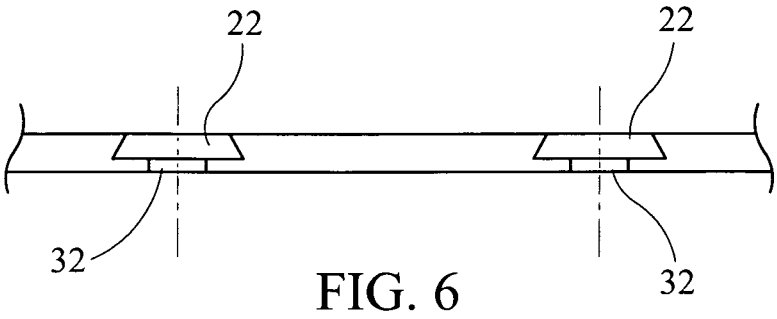
FIG. 6 is a longitudinal section of a lock strip for the attachment according to the present invention.
Figure 7:
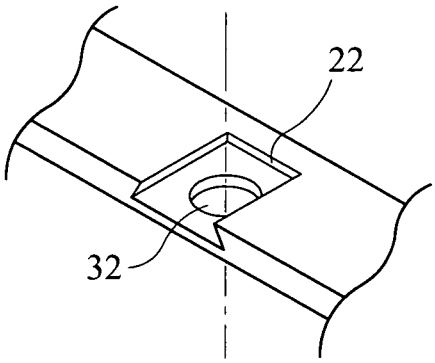
FIG. 7 is a perspective view of a section of lock strip for the attachment according to the present invention.
Figure 8:
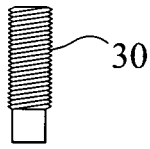
FIG. 8 is a detail view of a lock screw for the attachment according to the present invention.

Referring now to the drawing, and in particular to FIG. 1, an attachment 10 is for use with a chain saw 12 having a housing 14 containing a motor (not shown) with a chain bar 16 extending outwardly from the housing and a cutting chain 18 driven by the motor so as to travel longitudinally around from the top to the bottom of the chain bar. Referring also to FIGS. 2 through 8, attachment 10 includes a lock strip 20 aligned with and near the bottom edge of the chain bar. The lock strip forms a plurality of non-circular indentations 22, and a plurality of substantially C-shaped stop members 24 for engaging the non-circular indentations formed in the lock strip with one leg 26 and the opposite side of the bar chain with the other leg 28, wherein the leg of the substantially C-shaped stop member, which engages the non-circular indentation forms a shape which mates with the shape of the indentation, creating a snug fit. In one embodiment, indentations 22 are wedge shaped and the substantially C-shaped stop members form a matching dovetail so that the substantially C-shaped stop members are slid into the indentations and cannot be pulled loose. Substantially C-shaped stop members 24 are large enough to go around chain 18 without touching the chain and are also large enough to block brush and small limbs so as to be cut and from being dragged by the chain into housing 14. A preferred form of the attachment also includes a plurality of tightening screws 30, one tightening screw associated with each of the plurality of substantially C-shaped stop members for holding the C-shaped stop member in a tight relationship with both the lock strip and the chain bar. Each substantially C-shaped stop member forms a threaded opening for receiving the tightening screw.

In one arrangement of an attachment according to the present invention, each of the plurality of non-circular indentations is substantially square and the shape of the mating part of the leg of the substantially C-shaped stop member is also square to create a snug fit of the end of the leg into the indentation. Further, the lock strip also forms a plurality of circular cutouts 32, one circular cutout in the bottom of each substantially square indentation, through which a tightening screw 30 tightens substantially C-shaped stop member 24 and, therefore, lock strip 20 directly against chain bar 16.

The non-circular indentation and mating leg of the substantially C-shaped stop members can be at any angle or even at different angles with respect to each other, but in one preferred arrangement, the substantially C-shaped stops are at a substantially right angle to the bottom edge of the chain bar.

In a preferred form of an attachment according to the present invention, the tightening screws and the substantially C-shaped stop members can be removed and the lock strip can be moved to different places along the bottom edge of chain bar, where the substantially C-shaped stop members and the tightening screws can be re-attached.

From the foregoing it will be seen that this invention is well adapted to attain all of the ends and objectives hereinabove set forth, together with other advantages which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawings is to be interpreted as illustrative and not in a limiting sense.

SEQUENCE LISTING

Not Applicable

The invention claimed is:

1. A chainsaw, comprising in combination:

a housing;

a motor within the housing;

a chain bar extending outwardly from the housing, the chain bar having a first side, a second side and an outer edge having a top and a bottom;

a cutting chain driven by the motor so as to travel longitudinally around the the chain bar, the chain traveling away from the housing on the top of the chain bar and the chain traveling toward the housing on the bottom of the chain bar;

a lock strip aligned with and near the bottom of the first side of the chain bar, wherein the lock strip forms a plurality of non-circular indentations; and a plurality of substantially C-shaped stop members, each of the substantially C-shaped stop members having a first leg at one end and a second leg at the other end, wherein each of the first legs and respective ones of the second legs are connected by a central curved portion, each of the first legs engaging a respective one of the non-circular indentations formed in the lock strip and each of the second legs engaging a second side of the chain bar opposite the first legs, wherein the first leg of each of the substantially C-shaped stop members has a shape which mates with a shape of the respective one of the non-circular indentations allowing for the engagement to be a snug fit, and wherein each of the substantially C-shaped stop members is configured to go around the chain without touching the chain and configured to block brush and limbs that have been cut from being dragged by the chain into the housing.

2. A chainsaw according to claim 1, further comprising a plurality of tightening screws, one tightening screw associated with each of the plurality of substantially C-shaped stop members for holding the C-shaped stop member in a tight relationship with both the lock strip and the chain bar, wherein each substantially C-shaped stop member forms a threaded opening for receiving the tightening screw.

3. A chainsaw according to claim 2, wherein the shape of each of the plurality of non-circular indentations is substantially square shaped.

4. A chainsaw according to claim 3, wherein each of the substantially square indentations includes a bottom and the lock strip also forms a plurality of circular cutouts, one circular cutout in the bottom of each substantially square indentation, through which the tightening screw tightens the substantially C-shaped stop member and, therefore, the lock strip directly against the chain bar.

5. A chainsaw according to claim 4, wherein the substantially C-shaped stop members are at a substantially right angle to the bottom of the chain bar.

6. A chainsaw according to claim 1, wherein the shape of each of the plurality of non-circular indentations is substantially square shaped.

7. A chainsaw according to claim 6, wherein the substantially C-shaped stop members are at a substantially right angle to the bottom of the chain bar.

8. A chainsaw according to claim 1, wherein the substantially C-shaped stop members are at a substantially right angle to the bottom of the chain bar.

9. A chainsaw according to claim 1 further comprising a plurality of tightening screws, one tightening screw associated with each of the plurality of substantially C-shaped stop members for holding the C-shaped stop member in a tight relationship with both the lock strip and the chain bar, wherein each substantially C-shaped stop member forms a threaded opening for receiving the tightening screw, wherein the tightening screws and the substantially C-shaped stop members can be removed and the lock strip can be moved to different places along the bottom of the chain bar, where the substantially C-shaped stop members and the tightening screws can be re-attached.

10. An attachment for use with a chainsaw comprising: a lock strip for aligning with and near a bottom of a chain bar of the chainsaw, wherein the lock strip forms a plurality of non-circular indentations; and a plurality of substantially C-shaped stop members, each of the substantially C-shaped stop members having a first leg at one end and a second leg at the other end, wherein each of the first legs and respective ones of the second legs are connected by a central curved member, each of the first legs engaging a respective one of the non-circular indentations formed in the lock strip, wherein the first leg of each of the substantially C-shaped stop members has a shape which mates with a shape of the respective one of the non-circular indentations allowing for the engagement to be a snug fit, and wherein each of the substantially C-shaped stop members is configured to block brush and limbs that have been cut from being dragged past the plurality of substantially C-shaped stop members.

11. An attachment according to claim 10, further comprising a plurality of tightening screws, one tightening screw associated with each of the plurality of substantially C-shaped stop members for holding the C-shaped stop member in a tight relationship with both the lock strip and the chain bar, wherein each substantially C-shaped stop member forms a threaded opening for receiving the tightening screw.

12. An attachment according to claim 11, wherein the shape of each of the plurality of non-circular indentations is substantially square shaped.

13. An attachment according to claim 12, wherein each of the substantially square indentations includes a bottom and the lock strip also forms a plurality of circular cutouts, one circular cutout in the bottom of each substantially square indentation, through which the tightening screw tightens the substantially C-shaped stop member and, therefore, the lock strip directly against the chain bar.

14. An attachment according to claim 10, wherein the shape of each of the plurality of non-circular indentations is substantially square shaped.

15. An attachment according to claim 10 further comprising a plurality of tightening screws, one tightening screw associated with each of the plurality of substantially C-shaped stop members for holding the C-shaped stop member in a tight relationship with both the lock strip, wherein each substantially C-shaped stop member forms a threaded opening for receiving the tightening screw, wherein the tightening screws and the substantially C-shaped stop members can be removed and the lock strip can be moved, where the substantially C-shaped stop members and the tightening screws can be re-attached.

* * * * *